US005156638A

United States Patent [19]

Wirz

[11] Patent Number: 5,156,638

[45] Date of Patent: Oct. 20, 1992

[54] SHEET-FED ROTARY OFFSET PRINTING PRESS WITH A PLURALITY OF PRINTING UNITS

[75] Inventor: Arno Wirz, Bammental, Fed. Rep. of Germany

[73] Assignee: Heidelberger Druckmaschinen AG, Heidelberg, Fed. Rep. of Germany

[21] Appl. No.: 828,715

[22] Filed: Jan. 31, 1992

[30] Foreign Application Priority Data

Jan. 31, 1991 [DE] Fed. Rep. of Germany ..... 4102780

[51] Int. Cl.[5] ..... B41F 9/00

[52] U.S. Cl. ..... 101/142; 101/177; 101/183; 101/216; 101/410

[58] Field of Search ..... 101/183, 181, 136, 137, 101/141, 142, 152, 212, 216, 217, 218, 177, 410

[56] References Cited

U.S. PATENT DOCUMENTS

| | | | |
|---|---|---|---|
| 2,100,852 | 11/1937 | Jacobson | 101/137 |
| 3,999,480 | 12/1976 | Yamamoto et al. | 101/177 |
| 4,154,165 | 4/1979 | Jeschke | 101/177 |
| 4,231,291 | 11/1980 | Davidson, Jr. et al. | 101/137 |
| 4,711,172 | 12/1987 | Capdebose et al. | 101/183 |
| 4,732,084 | 3/1988 | Wirz | 101/177 |
| 4,774,883 | 10/1988 | Mailander | 101/137 |
| 4,838,160 | 6/1989 | Nozawa | 101/183 |
| 4,854,231 | 8/1989 | Jahn | 101/177 |
| 4,875,936 | 10/1989 | Hermach | 101/177 |
| 5,085,143 | 2/1992 | Becuer | 101/410 |

FOREIGN PATENT DOCUMENTS

| | | | |
|---|---|---|---|
| 0161522 | 6/1990 | European Pat. Off. . | |
| 1248066 | 8/1967 | Fed. Rep. of Germany . | |
| 2639900 | 5/1977 | Fed. Rep. of Germany . | |
| 8528483 | 6/1988 | Fed. Rep. of Germany . | |
| 1514108 | 6/1978 | United Kingdom . | |
| 2189745 | 11/1987 | United Kingdom | 101/181 |

*Primary Examiner*—Eugene H. Eickholt

*Attorney, Agent, or Firm*—Herbert L. Lerner; Laurence A. Greenberg

[57] ABSTRACT

A sheet-fed rotary offset printing press having a plurality of in-line conventionally mass-produced printing units with plate and blanket cylinders of given unitary diameter and sheet-guiding cylinders having respective diameters which are a multiple of the given unitary diameter, mechanically acting gripper systems carried by the sheet-guiding cylinders for in-line transfer of sheets at a given angular position of the sheet-guiding cylinders and for transporting the sheets in a given travel direction, the printing units having side walls with respective rear and forward edges having supporting and bolt-on surfaces for mutually connecting the side walls of the respective printing units, includes a conventionally mass-produced sheet-transfer cylinder having the given unitary diameter operatively connecting and maintaining an angular position of a point of tangency for sheet transfer both of a sheet-releasing cylinder of one of the printing units and a sheet-guiding cylinder of a succeeding printing unit, the sheet-releasing cylinder being mounted at opposite ends thereof in the respective side walls at a bore position located at a given elevation, the sheet-transfer cylinder being mounted at opposite ends thereof in respective auxiliary side walls at a bore position located at an identical elevation as that of the bore position for the sheet-releasing cylinder, the auxiliary side walls being formed with supporting and bolt-on surfaces complementary to the supporting and bolt-on surfaces of the side walls of the printing units.

3 Claims, 3 Drawing Sheets

SHEET-FED ROTARY OFFSET PRINTING PRESS WITH A PLURALITY OF PRINTING UNITS

Figure 1:
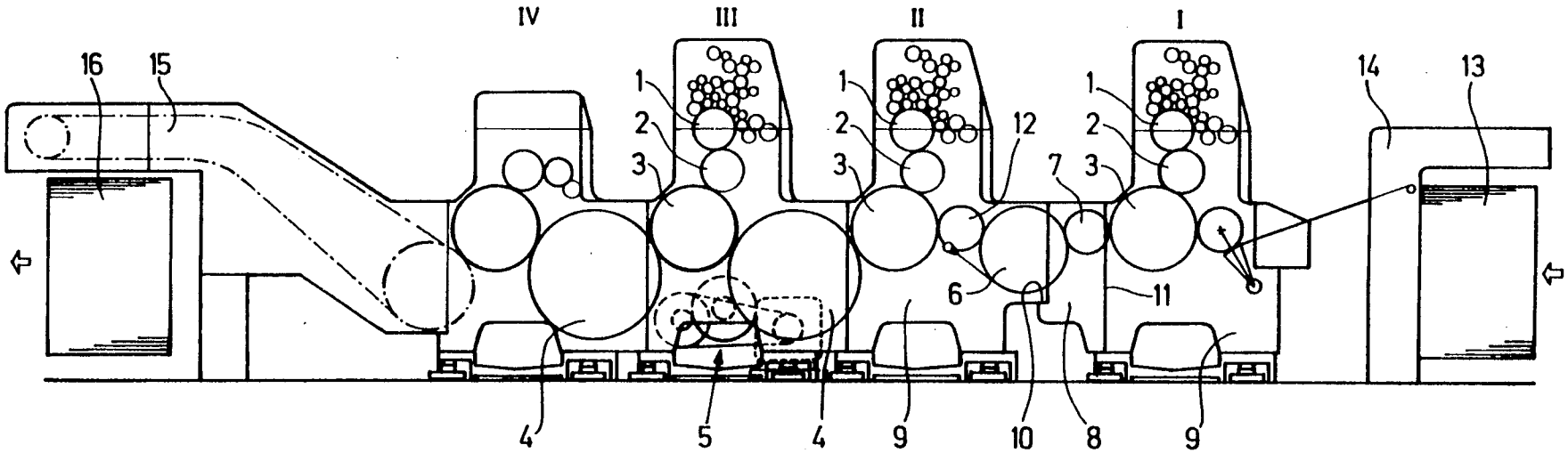

The invention relates to a sheet-fed rotary printing press with a plurality of printing units and, more particularly, having an in-line arrangement, either for multicolor printing or first form and perfector printing on paper or cardboard, the printing units having plate and blanket cylinders of given unitary diameter and sheet-guiding cylinders having respective diameters which are a multiple of the given unitary diameter, the sheet-guiding cylinders having mechanically acting gripper systems for in-line transfer of sheets at a given angular position of the sheet-guiding cylinders and for transporting the sheets in a given travel direction, the printing units having side walls with respective rear and forward edges having supporting and bolt-on surfaces for mutually connecting the side walls of the respective printing units.

These features of a sheet-fed rotary offset printing press have become known heretofore from German Published Non-Prosecuted Patent Application (DE-OS) 34 18 443.

The printing press described therein is selectively convertible from single-side multicolor sheet printing to first-form and perfector printing or the reverse. In this regard, there are provided in the side walls of a lower part of the printing units of this heretofore known press, respective pairs of bearing bores located vertically above one another for supporting sheet transfer cylinders of the printing unit, the lower bearing bore being provided for a sheet transfer cylinder having three times a conventional unitary diameter of the plate and blanket cylinders of the printing units, and the upper bearing bore being provided either for a sheet transfer cylinder having double the conventional unitary diameter or for a sheet turning cylinder having two pincers or tongs-type gripper systems disposed thereon with a 180°-offset. This permits the use of the identical side walls for the printing units in one sheet-fed rotary offset printing-machine which is then selectively convertible from one to the other operational type of printing press. Such a construction is preferred for printing machines having sheet transfer cylinders with diameters which are a multiple of the conventional unitary diameter of the plate and blanket cylinders, especially sheet transfer cylinders having triple the unitary diameter for multicolor printing on cardboard in order to achieve a slight curvature of the sheets on the respective cylinder.

An in-line sheet-fed rotary offset printing press has also become known from German Petty Patent (DE-GM) 85 28 483, in which impression cylinders of successive printing units are connected to one another by additionally arranged sheet-guiding units in which there are located, identically and precisely in position with the successive printing units, a sheet-guiding cylinder having a diameter double the conventional unitary diameter of the plate or blanket cylinder thereof or a plurality of successive sheet-guiding cylinders having the conventional unitary diameter or diameters double the unitary diameter. What is aimed for is a combination of just one sheet-guiding cylinder with double the unitary diameter between single-side printing presses with an impression cylinder having a diameter double that of the unitary diameter and a plurality of sheet-guiding cylinders between first form and perfector printing presses with two impression cylinders, in order to achieve a selective printing-press construction which suits the needs of the customer and thus affords a rational manufacture and assembly of such printing presses with varying sheet-travel or transport characteristics. It has accordingly become known from this publication how to connect together identical printing units by means of an additional or auxiliary sheet-guiding unit having components which, however, to a very great extent are not identical with the mass-produced components of the printing units which are to be connected together.

Conversely it is an object of the invention to provide a sheet-fed rotary printing press of the foregoing general type having, in the vicinity of the location at which a sheet is turned, a low-cost, i.e. economical, connection of successive, mass-produced printing units with sheet-guiding cylinders having unitary diameter and diameters which are a multiple thereof, the connection being formed primarily of mass-produced components of the printing units which are to be connected together, including the turning device.

With the foregoing and other objects in view, there is provided, in accordance with the invention, a sheet-fed rotary offset printing press having a plurality of in-line conventionally mass-produced printing units with plate and blanket cylinders of given unitary diameter and sheet-guiding cylinders having respective diameters which are a multiple of the given unitary diameter, mechanically acting gripper systems carried by the sheet-guiding cylinders for in-line transfer of sheets at a given angular position of the sheet guiding cylinders and for transporting the sheets in a given travel direction, the printing units having side walls with respective rear and forward edges having supporting and bolt-on surfaces for mutually connecting the side walls of the respective printing units, comprising a conventionally mass-produced sheet-transfer cylinder having the given unitary diameter operatively connecting and maintaining an angular position of a point of tangency for sheet transfer both of a sheet-releasing cylinder of one of the printing units and a sheet-guiding cylinder of a succeeding printing unit, the sheet-releasing cylinder being mounted at opposite ends thereof in the respective side walls at a bore position located at a given elevation, the sheet-transfer cylinder being mounted at opposite ends thereof in respective auxiliary side walls at a bore position located at an identical elevation as that of the bore position for the sheet-releasing cylinder, the auxiliary side walls being formed with supporting and bolt-on surfaces complementary to the supporting and bolt-on surfaces of the side walls of the printing units.

In accordance with another view of the invention, the supporting and bolt-on surfaces of the side walls of the one and the succeeding printing units are connected, respectively, to the supporting and bolt-on surfaces of the auxiliary side walls.

In accordance with a concomitant feature of the invention, there are provided means for converting the printing units from multicolor printing on one side of a sheet to first form and perfector printing, and the reverse.

An advantage of these structural features is that it is merely necessary to manufacture a small additional or auxiliary wall for both sides of the printing press, the auxiliary wall having supporting and stop surfaces complementary to the corresponding surfaces on the side walls of the successive mass-produced printing units to be connected together, the printing units having impression cylinders with diameters double the unitary diameter of the plate and blanket cylinders and which otherwise remain unaltered. The features according to the invention permit a low-cost or economical connection of printing units with identical or different cylinder systems, so that very great flexibility is achieved in the construction, manufacture and assembly of the sheet fed rotary offset printing presses for printing on paper and cardboard. By providing a bore position or location for a first sheet-transfer drum of unitary diameter in the auxiliary side wall, for example with the cylinder of the mass-produced turning device formed of storage drum and a following turning drum with pincer-type gripper for a first form and perfector printing press for cardboard, it is possible to employ existing mass-produced components for all of the required cylinders, cams for gripper control and the like. The application of the features according to the invention, therefore, provides wide-ranging possibilities for rational construction and manufacture of a sheet-fed rotary offset printing press for multicolor printing on one side of a sheet and for first form and perfector printing on paper and cardboard made up of printing units with identical and different cylinder systems in accordance with customer-specific requirements, taking into account special demands with regard to the processing of the sheets to be printed. It is possible, in this connection, to make use of the advantage deriving from a smear-free printing on one side of a sheet due to the provision of transfer drums having triple the unitary diameter of the plate and blanket cylinders for a contactless sheet transport.

Other features which are considered as characteristic for the invention are set forth in the appended claims.

Although the invention is illustrated and described herein as embodied in a sheet-fed rotary offset printing press with a plurality of printing units, it is nevertheless not intended to be limited to the details shown, since various modifications and structural changes may be made therein without departing from the spirit of the invention and within the scope and range of equivalents of the claims.

Figure 2:
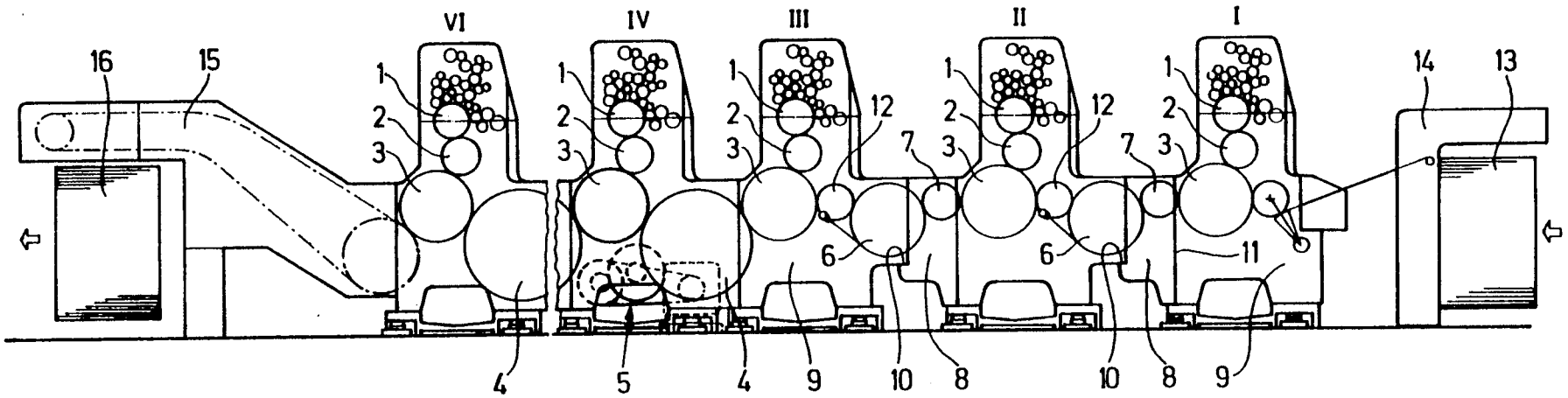
Figure 3:
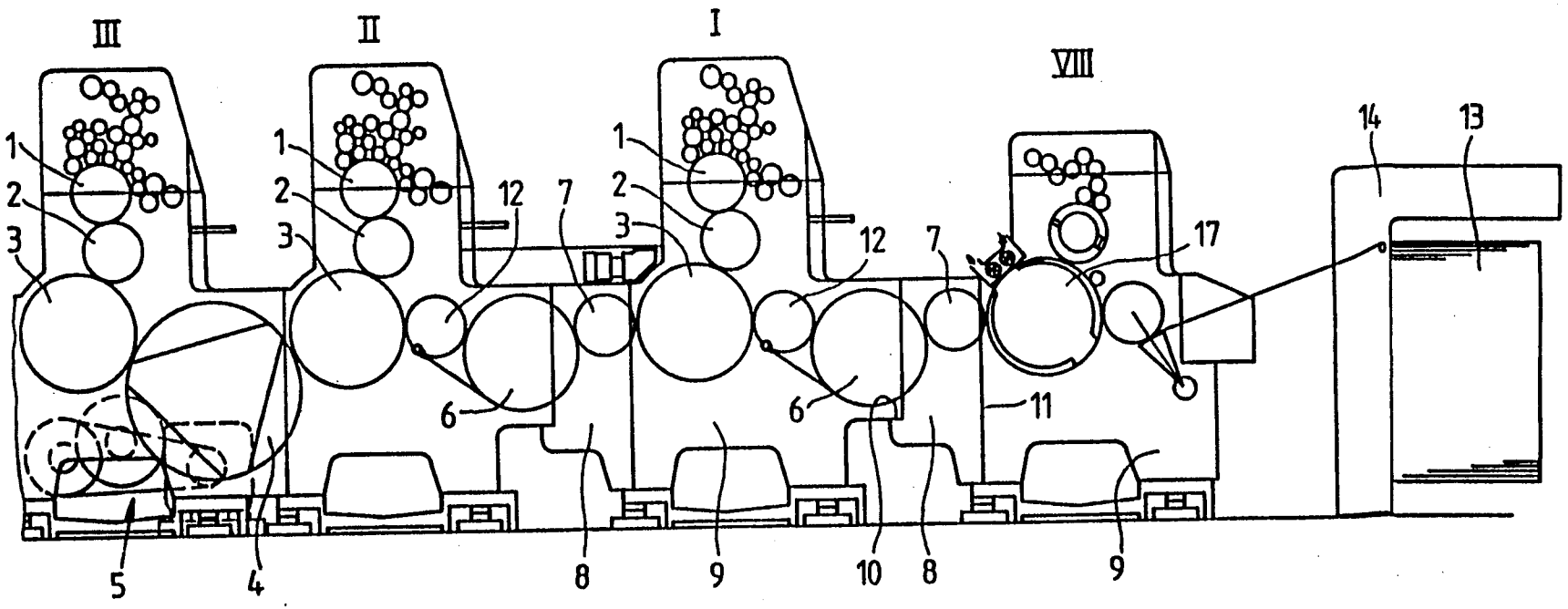

The construction and method of operation of the invention, however, together with additional objects and advantages thereof will be best understood from the following description of specific embodiments when read in connection with the accompanying drawings, in which:

FIG. 1 is a diagrammatic side elevational view of a convertible first form and perfecting printing press for printing on cardboard having three printing units and a following varnishing unit;

FIG. 2 is a view like that of FIG. 1 of a printing press for printing on cardboard having six printing units and two turning devices; and FIG. 3 is an enlarged fragmentary view similar to that of FIG. 1 of a printing press for printing on cardboard having several printing units and a work-and-tumble device with a converter or finishing unit preceding a turning device. Like parts are identified by the same reference numerals in each of the figures.

Referring now to the drawings and, first, particularly, to FIG. 1 thereof, there is shown therein a printing press which is convertible from single-side sheet printing to first form and perfector printing and the reverse. The illustrated printing press has three in-line printing units I, II and III, which are followed by a varnishing unit IV. Plate cylinders 1 and rubber-blanket cylinders 2 in the printing units I, II and III have a like diameter of a given standard size. Conversely, impression cylinders 3 of the printing units I, II and II have a diameter twice that of the given standard size primarily to be able to print on paper of thicker quality and cardboard having a high quality requirement. Disposed between the printing units II and III as well as between the printing unit III and the varnishing unit IV are sheet-transfer drums 4 having a diameter triple that of the given standard size. The printing press is driven by a driving device 5, which acts upon the sheet-transfer drum 4 in the printing unit III. Between the printing units I and II, which have respective side walls 9, the impression cylinders 3 having double the given diameter of the plate and blanket cylinders 1 and 2 are connected by a storage drum 6 of like double diameter to a turning drum 12 of the given single diameter and by a sheet-transfer drum 7 of like given single diameter to one another, the sheet-transfer drum 7 being mounted on and between small additional or auxiliary walls 8. The additional walls 8, respectively provided on both sides of the printing press, are disposed between the side walls 9 of the printing units I and II, which are to be connected together. On opposite edges of the additional walls 8, respective supporting surfaces 10 and stop surfaces 11 are provided which are complementary to the respective supporting and stop surfaces on the side walls 9 of the printing units I and II, the side walls 9 being thereby connected together by the additional walls 8. The sheet transfer drum 7 mounted on the additional walls 8 is a conventional sheet-transfer drum taken from those which are mass-produced for the printing units which are to be connected together. No additional components for controlling gripper systems or for other purposes are required. In such a printing press, a sheet which has been lifted off a pile of sheets 13 and has been fed by a feeder 14 to the first printing unit I, can initially be perfector-printed and then, after being turned over, can be first-form printed in the printing units II and III, before it is deposited, via a delivery 15, on a pile of sheets 16 in the delivery after passing through the varnishing unit IV. The arrangement shown, however, also permits the sheets, particularly cardboard sheets, to be printed on a single side thereof in all of the printing units I, II and III with the turning device shut off.

In the sheet-fed rotary offset printing press shown in FIG. 2, six successive printing units I, II, III, IV, V (non-illustrated) and VI are connected to one another in-line between a feeder 14 with a pile of sheets 13, and a delivery 15 with a pile of sheets 16. Plate cylinders 1 and rubber blanket cylinders 2 of the printing units I–IV are of a given unitary diameter. Conversely, the impression cylinders 3 are double the given unitary diameter primarily for enabling the printing of very thick paper qualities and cardboard having high quality requirements. Sheet-transfer drums 4 having triple the given unitary diameter are disposed between the printing units III and IV, the printing units IV and V, and the printing units V and VI. The printing press is driven by a driving device 5, which acts upon the sheet-transfer drum 4 in the printing unit IV. Between the printing units I and II/II and III, all of which have opposing side walls 9, the impression cylinders 3 of double-diameter size are connected to storage drums 6 of like double-diameter size by a turning drum 12 having the given unitary diameter and to one another by a sheet-transfer drum 7 also having the given unitary diameter, the sheet-transfer drum 7 being mounted on and between small additional side walls 8. The additional walls 8 are located, respectively, on both sides of the printing press, and are disposed between the side walls 9 of the printing units which are to be connected together. The additional side walls 8 are formed at opposite edges thereof with respective supporting surfaces 10 and stop surfaces 11, which complement supporting and stop surfaces found on the respective side walls 9 of the printing units, the side walls 9 being connected to one another by the additional side walls 8. The sheet-transfer drum 7 is taken from existing mass produced printing units which are to be connected together. No additional components for controlling gripper systems or for other purposes are necessary. In the center of FIG. 2, the construction of the features according to the invention is clearly shown between two printing units II and III having identical cylinder systems. The printing units I and II have different cylinder systems, so that a corresponding application of the features according to the invention is thereby explained. In both cases, the bore position or the position of the rotational shaft of the transfer drum 7 having the given unitary diameter, and being mounted in the small additional side walls 8, is at the same height as the bore or shaft position of the impression cylinder 3, which releases the sheet thereto, so that the angular position of the point of tangency for releasing the sheet from the impression cylinder 3 as well as for acceptance of the sheet by the storage drum 6, which is positioned upstream of the turning drum 12 in the travel direction of the sheet, is maintained.

The embodiment of a printing press for printing on cardboard shown in FIG. 3 in an enlarged fragmentary view, when compared with the views in FIGS. 1 and 2, has several in-line printing units I, II, III ... and a work-and-tumble device VIII with a converting or finishing unit preceding the printing units. Plate cylinders 1 and rubber-blanket cylinders 2 of given unitary diameter are provided in the printing units. Conversely, impression cylinders 3 thereof are double the diameter of the plate and blanket cylinders 1 and 2 thereof. A sheet-transfer drum 4 between the printing units II and III is of triple the given unitary diameter. A driving device 5 acts upon the sheet-transfer drum 4. Between the printing units I and II, the double-diameter impression cylinders 3 are connected by a corresponding double-diameter storage drum 6 to a single or given unitary diameter turning drum 12 and by a correspondingly single or given unitary-diameter sheet-transfer drum 7 to one another, the sheet-transfer drum 7 being mounted in additional side walls 8 similar in form and construction to those of the printing-press embodiments shown in FIGS. 1 and 2. Similarly, between a double-diameter cylinder 17 of the work-and tumble device VIII with the finishing unit or the like and the double-diameter storage drum 6 located upstream of the first printing unit I in the travel direction of the sheet is a unitary-diameter sheet-transfer drum 7 mounted on and between additional side walls 8, conforming with the aforedescribed arrangement. This embodiment of FIG. 3 also demonstrates the possibilities afforded by the features according to the invention, for a rational construction and manufacture of a sheet-fed rotary offset printing press for multi-color printing and for first form and perfector printing on paper and cardboard made up of printing units with identical and different cylinder systems from regular mass production in accordance with customer-specific requirements, taking special demands into consideration. This low-cost or economical connection, in all applications, of existing mass-produced side walls for identical or different printing units with identical or different cylinder systems avoids changes in the side walls and permits the use of all existing mass-produced cylinders, for example turning cylinders, storage drums and first transfer drums for a first form and perfector printing press for printing on cardboard.

I claim:

1. Sheet-fed rotary offset printing press having a plurality of in-line conventionally mass-produced printing units with plate and blanket cylinders of given unitary diameter and sheet-guiding cylinders having respective diameters which are a multiple of the given unitary diameter, mechanically acting gripper systems carried by the sheet-guiding cylinders for in-line transfer of sheets at a given angular position of the sheet-guiding cylinders and for transporting the sheets in a given travel direction, the printing units having side walls with respective rear and forward edges having supporting and bolt-on surfaces for mutually connecting the side walls of the respective printing units, comprising a conventionally mass-produced sheet-transfer cylinder having the given unitary diameter operatively connecting and maintaining an angular position of a point of tangency for sheet transfer both of a sheet-releasing cylinder of one of the printing units and a sheet-guiding cylinder of a succeeding printing unit, the sheet-releasing cylinder being mounted at opposite ends thereof in the respective side walls at a bore position located at a given elevation, said sheet-transfer cylinder being mounted at opposite ends thereof in respective auxiliary side walls at a bore position located at an identical elevation as that of the bore position for the sheet-releasing cylinder, the auxiliary side walls being formed with supporting and bolt-on surfaces complementary to the supporting and bolt-on surfaces of the side walls of the printing units.

2. Sheet-fed rotary offset printing press according to claim 1, wherein the supporting and bolt-on surfaces of the side walls of the one and the succeeding printing units are connected, respectively, to the supporting and bolt-on surfaces of the auxiliary side walls.

3. Sheet-fed rotary offset printing press according to claim 1, including means for converting the printing units from multicolor printing on one side of a sheet to first form and perfector printing, and the reverse.

* * * * *